United States Patent [19]

Dooley et al.

[11] Patent Number: 4,899,904

[45] Date of Patent: Feb. 13, 1990

[54] BEVERAGE CAN CARTRIDGE

[76] Inventors: Leslie T. Dooley, 2825 Whitener, Apt. A2, Cape Girardeau, Mo. 63701; Stephen L. Perry, 302 Harrison, Sikeston, Mo. 63801

[21] Appl. No.: 251,837

[22] Filed: Oct. 3, 1988

[51] Int. Cl.[4] ..... B65D 81/18

[52] U.S. Cl. ..... 220/413; 62/457.5; 206/545; 220/412

[58] Field of Search ..... 62/371, 457, 457.1, 62/457.3, 457.4, 457.5, 457.7; 206/427, 545, 546, 549, 514; 220/3.1, 4 R, 20, 411–413; 312/35, 36, 45, 72

[56] References Cited

U.S. PATENT DOCUMENTS

| | | | |
|---|---|---|---|
| 1,042,249 | 10/1912 | Mickelson | 62/457.7 |
| 2,038,989 | 4/1936 | Castle | 220/413 |
| 2,400,742 | 5/1946 | Clerc . | |
| 2,538,780 | 1/1951 | Hazard | 312/36 |
| 2,631,402 | 3/1953 | Lastofka . | |
| 2,645,332 | 7/1953 | Martin et al. | 206/545 |
| 2,996,344 | 8/1951 | Garman | 312/45 |
| 3,018,149 | 1/1962 | Parker | 312/45 |
| 3,113,816 | 12/1963 | Hulsey | 312/72 |
| 3,178,242 | 4/1965 | Ellis et al. | 312/45 |
| 3,254,502 | 6/1966 | Ellis | 62/457.1 |
| 3,255,607 | 6/1966 | Bair et al. . | |
| 3,395,550 | 9/1968 | Dungan . | |
| 3,401,535 | 9/1968 | Palmer | 62/457.5 |
| 4,106,597 | 8/1978 | Shook et al. | 206/545 |
| 4,796,758 | 1/1989 | Hauk | 206/545 |

*Primary Examiner*—Jimmy G. Foster

*Attorney, Agent, or Firm*—Rogers, Howell & Haferkamp

[57] ABSTRACT

A storage device for beverage cans includes an enclosure having a cover. The cover is attached to the enclosure by a hinge. A latch is mounted on the cover and enclosure to lock the cover in place. The device is inserted into and attached to a modified cooler. The modified cooler has a side opening into which the device is inserted. The modified cooler consists of an outer shell, an insulated liner inserted within the outer shell, and an inner shell fitted within the liner. The liner has a sloped section which is sloped from the back of the cooler toward the front. With the device placed on the sloped section, the beverage cans will roll forward when the cover is opened.

18 Claims, 2 Drawing Sheets

BEVERAGE CAN CARTRIDGE

BACKGROUND OF THE INVENTION

This invention relates to a storage device for beverage cans and more particularly to a portable storage device in which beverage cans may be securely stored and transported.

Thermal chests or coolers are popular containers used for storing and carrying food, ice, and beverage cans for picnics or other outings. Various coolers for storing and carrying perishable items are disclosed in U.S. Pat. No. 3,255,607 and 3,395,550. Typically, ice, either in bags or loose, is placed in the coolers along with the food and beverage cans to keep the contents cold. Coolers are convenient for storing food and ice; however, when a beverage can is desired, the cooler needs to be opened and its contents rummaged through to find the can. Even when a cooler only contains cans and ice, the can is usually wet due to its contact with the ice and any water which accumulates in the cooler due to the ice melting. Thus, care needs to be exercised in removing the can from the cooler because the can is wet. Also, movement of the cooler itself tends to shake the cans causing problems when the can is opened. The present invention overcomes these inconveniences.

SUMMARY OF THE INVENTION

In accordance with the present invention there is provided a beverage can cartridge generally comprising an enclosure having an open side adapted for receiving and containing a plurality of beverage cans and a cover for closing the open side of the enclosure. A latching mechanism is mounted on the enclosure and cover to hold the cover securely closed. The cover is mounted on the enclosure by means of a hinge so that the cover may be opened to expose the interior of the enclosure. The cartridge of the present invention is typically inserted into and attached to a modified version of a conventional cooler. The modified cooler consists of an outer shell, an insulated liner which fits within the outer shell, and an inner shell which fits within the liner. The liner has a sloped section which is inclined from the back of the liner toward the front of the liner. An opening is provided in a side of the modified cooler into which the cartridge is inserted at an angle. Thus, it can be seen that with the beverage can cartridge inserted into and attached to the modified cooler, the contents of the cartridge are separate from the contents of the cooler. The ice is not in contact with the beverage cans, but is in contact with the cartridge which keeps the cartridge and the cans cold.

To use the cartridge of the present invention the cartridge is filled with beverage cans. The cooler is then filled with ice. The ice insures that the cans stored in the cartridge will be kept cold. When a beverage is desired, a can may simply be removed from the cartridge by releasing the latching mechanism and opening the cover. Because the insulated liner has the sloped section the cans will roll forward when the cover is opened and the forward most can may be easily removed from the cartridge.

Hence, the present invention eliminates the inconvenience of opening the cooler, rummaging through the cooler, and lifting out a wet can by providing a cartridge for storing beverage cans which is separate from the interior compartment of the cooler. The cartridge is also removable from the cooler allowing the cartridge to be cooled prior to insertion in the cooler. These and other advantages of the invention are apparent from the detailed description to follow.

DETAILED DESCRIPTION OF THE PREFERRED EMBODIMENT

Figure 1:
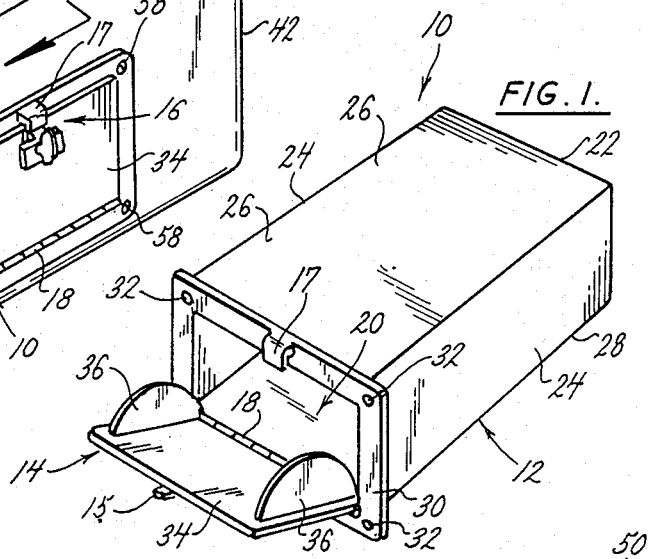
FIG. 1 is a perspective view of the beverage cartridge of the present invention.

Referring to the drawings, FIG. 1 illustrates a removable beverage can cartridge 10 of the present invention. The cartridge 10 is composed of essentially two parts, an enclosure 12 and a cover 14. A manually operated latching mechanism 16 is mounted on the enclosure 12 and cover 14 to hold the cover 14 closed. The latching mechanism includes a latch 15 and a catch 17. The cover 14 is mounted on the enclosure 12 by means of a hinge 18 so that the cover 14 may be opened to expose the interior 20 of the enclosure 12.

The enclosure 12 is a box-like structure having a rear section 22, a pair of side sections 24, a top section 26, and a bottom section 28. A front face plate 30 forms the front of the enclosure 12 and the hinges 18 attach the cover 14 to the face plate 30. The face plate 30 also includes a plurality of screw holes 32 around its perimeter.

The cover 14 is composed of a front panel 34 and a pair of side extensions or guards 36. The guards 36 serve to guide the beverage can out of the enclosure 12 on to the front panel 34 and keep the can in place until it is removed from the panel 34.

Figure 2:
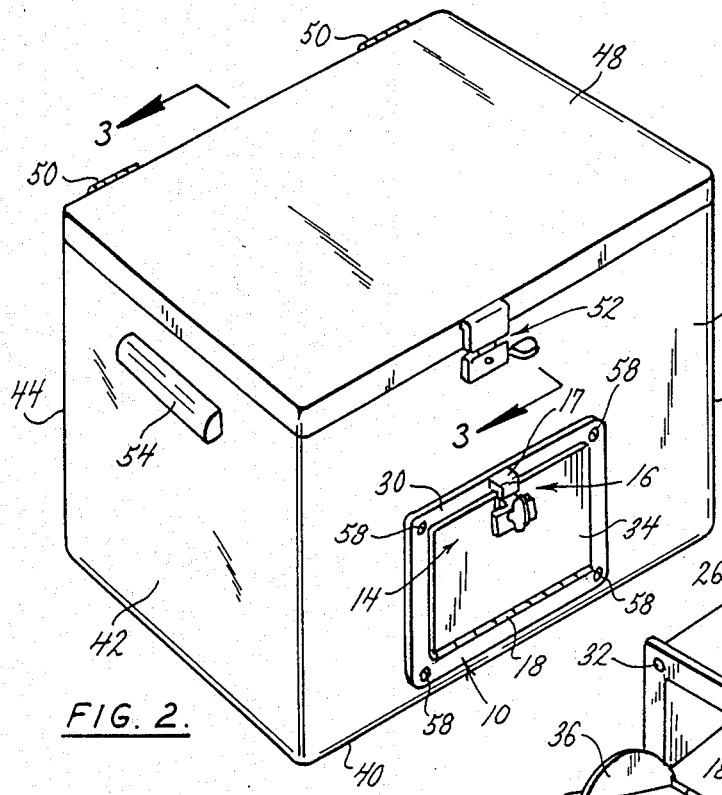
FIG. 2 is a perspective view of the beverage cartridge of the present invention installed in and attached to a modified cooler.

As shown in FIG. 2, the cartridge 10 has been inserted into and attached to a modified version of a conventional thermal insulated chest or cooler 38. The cooler 38 is a box-like structure having a bottom 40, a pair of sides 42, a back side 44, a front side 46, and a top 48. The top 48 of the cooler 38 is attached to the back 44 by a plurality of hinges 50. In order to lock the top 48 a locking mechanism 52 is provided. A pair of handles 54 are provided on each of the sides 42 to facilitate carrying the cooler 38. The cooler 38 also has an opening 56 in the front 46 which is adapted for insertion of the cartridge 10.

The cartridge 10 is inserted through the opening 56 and is secured to the front 46 of the cooler 38 by inserting a screw 58 into each of the screw holes 32 in the face plate 30 and the screw holes 72 in the cooler 38. Before or after installation of the cartridge 10 in the cooler 38, cans may be filled in the cartridge 10.

Figure 3:
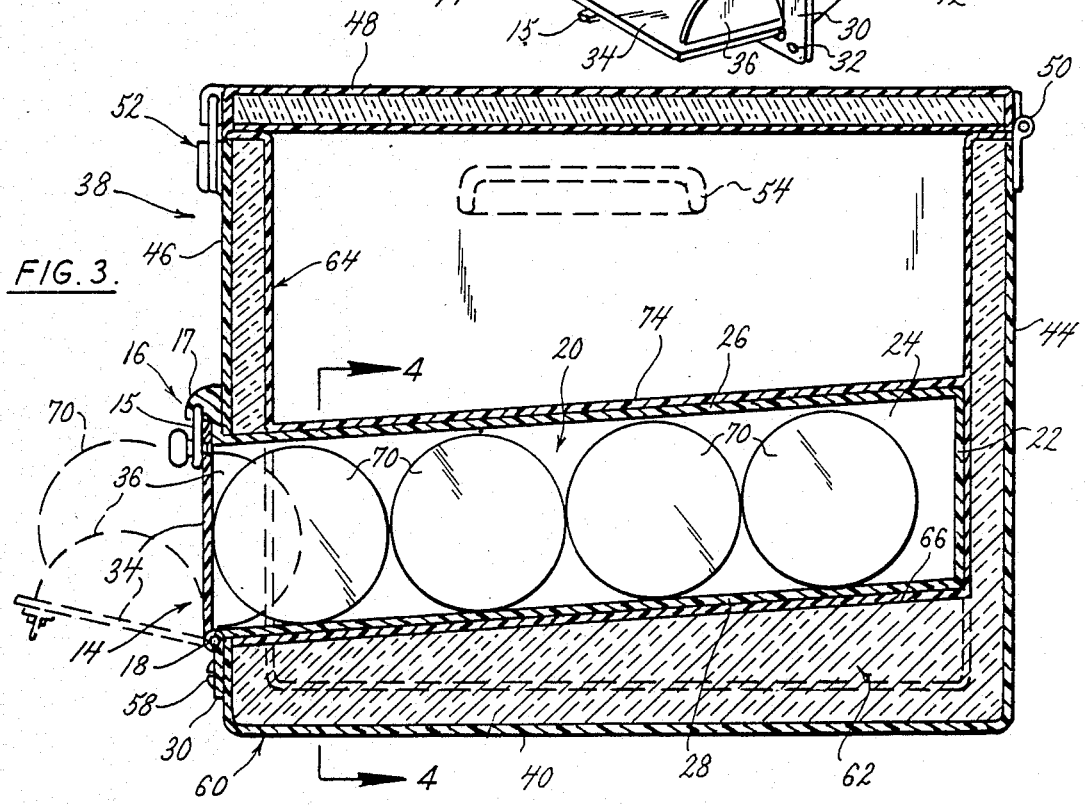
FIG. 3 is an enlarged cross-sectional view taken along the line 3—3 of FIG. 2.

A plurality of beverage cans 70 are shown stored in sequential order in the cartridge 10 in FIG. 3. The cover is shown in phantom being opened and one of the cans 70 (also shown in phantom) has rolled forward onto the front panel 34 due to the slope of the liner 62. Once the first can 70 is removed another can 70 rolls into place on the front panel 34.

The modified cooler 38 consists of an outer shell 60, an insulated inner liner 62 which fits within the outer shell 60, and an inner shell 64 which fits within the liner 62. The liner 62 has a sloped section 66 upon which the bottom 28 of the cartridge 10 rests when the cartridge 10 has been inserted into the cooler 38. The sloped section 66 is downwardly inclined from the back 44 of the cooler 38 toward the front 46. This sloped section 66 insures that the cans 70 will roll forward toward the cover 14 and on the front panel 34 when the cover 14 is opened.

Figure 4:
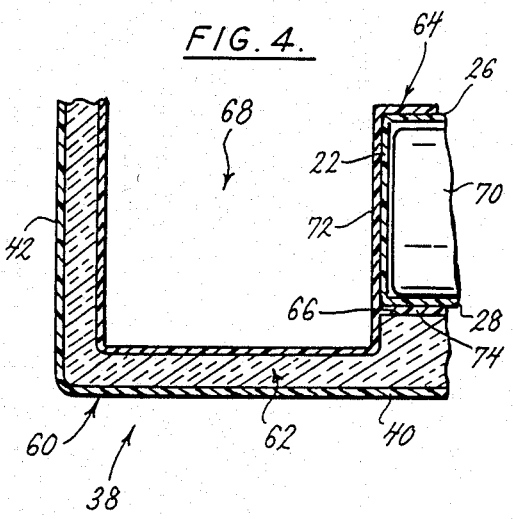
FIG. 4 is a partial cross-sectional view taken along the line 4—4 of FIG. 3.

The interior construction of the cooler 38 is shown in FIG. 4. The inner shell 64 is received in the outer shell 60 and the liner 62 is disposed therebetween. FIG. 4 also illustrates an interior compartment 68 in which food, ice, or other items may be stored during use of the cooler 38.

Figure 5:
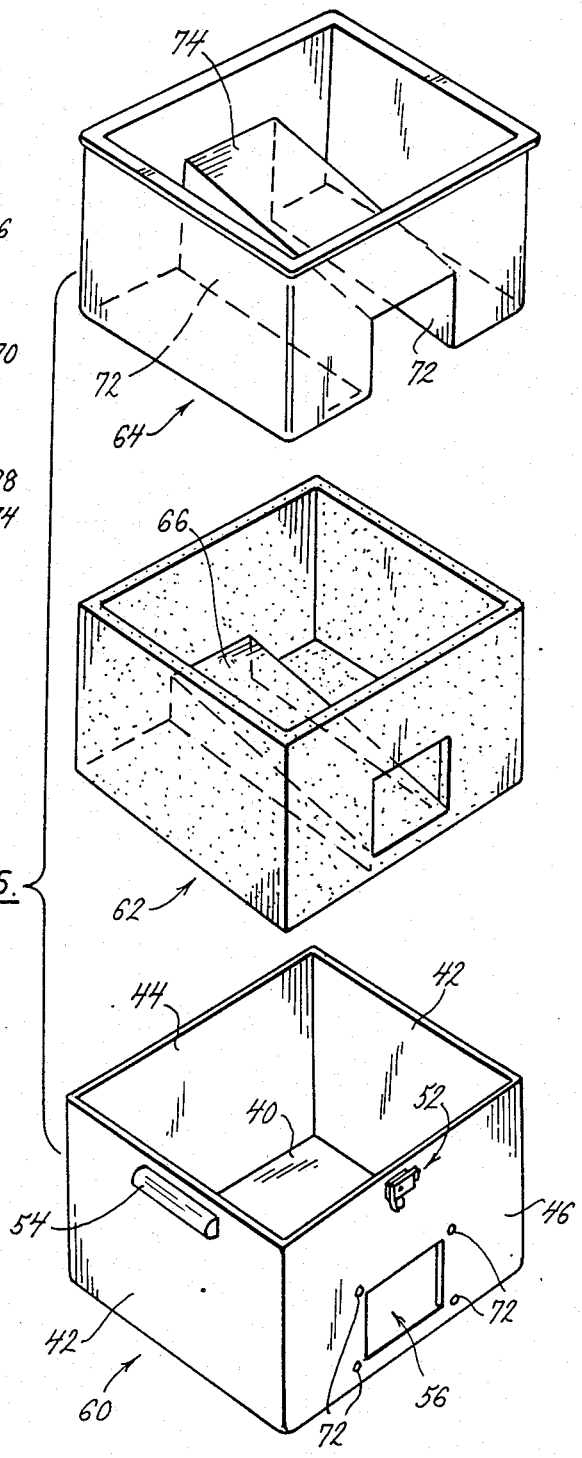
FIG. 5 is an exploded perspective view of the modified cooler of FIG. 2 with the beverage cartridge and top of the cooler removed.

FIG. 5 illustrates the construction of the modified cooler 38 with its top 48 removed. The cooler 38 consists of the outer shell 60, the insulated liner 62 which fits within the outer shell 60, and the inner shell 64 which fits within the liner 62. The liner 62 has the sloped section 66 upon which the bottom of the cartridge 10 rests when the cartridge 10 has been inserted into the cooler 38. The inner shell 64 has a pair of sides 72 and a top 74 for holding the cartridge 10 when it has been inserted into the cooler 38 through the opening 56.

Although the cartridge 10 has been shown inserted into and attached to a modified cooler 38, it is also possible to place the cartridge 10 into a conventional cooler. Thus, whenever a beverage can 70 is desired, the conventional cooler is opened and the cartridge 10 is also opened to remove a can 70 for use.

There are various changes and modifications which may be made to this invention as may be apparent to those skilled in the art. However, these changes or modifications are included in the teaching of the disclosure, and it is intended that the invention be limited by the scope of the claims appended hereto.

What is claimed is:

1. A storage device for beverage cans comprising:

a cooler having an interior compartment adapted to receive therein a quantity of ice and a side opening; and a removable cartridge for storing a plurality of beverage cans received within the opening of the cooler in detachable engagement therewith, the removable cartridge comprising an enclosure having an opening and a cover and comprising a box-like structure having a rear section, a pair of side sections, a top sections, a bottom section, and a front face plate comprising means for attaching the front face plate to the side of the cooler.

2. The device of claim 1 further comprising means for hingedly attaching the cover to the front face plate.

3. The device of claim 2 further comprising means for latching the cover to the front face plate.

4. A storage device for beverage cans comprising:

a portable cooler having an interior compartment adapted to receive therein a quantity of ice and an opening in a vertical side wall of the cooler, the opening extending over substantially less than the full expanse of the side wall of the cooler; and a removable cartridge for storing a plurality of beverage cans received within the opening of the cooler and in detachable engagement therewith, such that space for ice is available within the cooler about at least three sides of the cartridge, the interior of the cartridge being accessible while the interior compartment of the cooler remains enclosed.

5. The device of claim 4 wherein the removable cartridge comprises an enclosure having an opening and a cover.

6. The device of claim 5 wherein the enclosure comprises a box-like structure having a rear section, a pair of side sections, a top section, a bottom section, and a front face plate.

7. The device of claim 4 wherein the cooler comprises an outer shell, an insulated liner fitted within the outer shell, and an inner shell fitted within the liner.

8. The device of claim 7 wherein the cooler further comprises an interior compartment defined by the inner shell adapted to receive therein a quantity of ice.

9. The device of claim 8 wherein the removable cartridge comprises an enclosure having an opening and a cover.

10. The device of claim 9 wherein the enclosure comprises a box-like structure having a rear section, a pair of side sections, a top section, a bottom section, and a front face plate.

11. A storage device for beverage cans for insertion into an interior compartment of a cooler, the cooler comprising an outer shell, an insulated liner fitted within the outer shell, an inner shell fitted within the liner, and the interior compartment defined by the inner shell, the device comprising:

a box-like enclosure comprising a rear section, a pair of side sections, a top section, a bottom section, and a front face plate;

a cover comprising a front panel and a pair of side guards which are adapted to guide the beverage cans out of the enclosure onto the front panel;

means for hingedly attaching the cover to the front face plate; and means for locking the cover closed.

12. The device of claim 11 wherein the means for hingedly attaching the cover to the front face plate comprises a hinge.

13. The device of claim 12 wherein the means for locking the cover closed comprises a latch mounted on the cover and a catch mounted on the front face plate.

14. A storage device for beverage cans comprising:

a cooler having an interior compartment adapted to receive therein a quantity of ice and a side opening; and a removable cartridge for storing a plurality of beverage cans received within the opening of the cooler in detachable engagement therewith, the removable cartridge comprising an enclosure having an opening and a cover comprising a front panel and a pair of side guards which are adapted to guide the beverage cans out of the enclosure onto the front panel.

15. A storage device for beverage cans comprising:

a cooler having an interior compartment adapted to receive therein a quantity of ice and a side opening, the cooler comprising an outer shell, an insulated liner fitted within the outer shell and an inner shell fitted within the liner, the liner comprising a sloped section which is downwardly inclined from the back of the cooler toward the front of the cooler; and a removable cartridge for storing a plurality of beverage cans received within the opening of the cooler in detachable engagement therewith.

16. A storage device for beverage cans comprising:

a cooler comprising an outer shell, an insulated liner fitted within the outer shell, an inner shell fitted within the liner, and interior compartment defined by the inner shell adapted to receive therein a quantity of ice, and a side opening; and a removable cartridge for storing a plurality of beverage cans received within the opening of the cooler in detachable engagement therewith, the removable cartridge comprising an enclosure having an opening and a cover and comprising a box-like structure having a rear section, a pair of side sections, a top section, a bottom section and a front face plate comprising means for attaching the front face plate to the side of the cooler.

17. A storage device for beverage cans comprising:

a cooler comprising an outer shell, an insulated liner fitted within the outer shell, an inner shell fitted within the liner, and interior compartment defined by the inner shell adapted to receive therein a quantity of ice, and a side opening; and a removable cartridge for storing a plurality of beverage cans received within the opening of the cooler in detachable engagement therewith, the removable cartridge comprising an enclosure having an opening and a cover comprising a front panel and a pair of side guards which are adapted to guide the beverage cans out of the enclosure onto the front panel.

18. A storage device for beverage can comprising:

a cooler comprising an outer shell, an insulated liner fitted within the outer shell and comprising a sloped section which is downwardly inclined from the back of the cooler toward the front of the cooler, an inner shell fitted within the liner, and an interior compartment defined by the inner shell adapted to receive therein a quantity of ice, and a side opening; and a removable cartridge for storing a plurality of beverage cans received within the opening of the cooler in detachable engagement therewith.

* * * * *